United States Patent [19]

Thomas

[11] Patent Number: 4,903,715

[45] Date of Patent: Feb. 27, 1990

[54] HAIR FROSTING PURSE

[76] Inventor: Louis N. Thomas, 990 NE. 156th Terrace, N. Miami Beach, Fla. 33162

[21] Appl. No.: 367,792

[22] Filed: Jun. 19, 1989

[51] Int. Cl.[4] ..... A45O 19/18

[52] U.S. Cl. ..... 132/270

[58] Field of Search ..... 132/270, 207, 212, 220, 132/221, 222

[56] References Cited

U.S. PATENT DOCUMENTS

| | | | |
|---|---|---|---|
| 1,550,930 | 8/1925 | Sullivan | 132/212 |
| 3,692,032 | 9/1972 | Regas | 132/212 |
| 3,828,802 | 8/1974 | Spanel | 132/212 |
| 4,165,754 | 8/1979 | Di Pasqua | 132/270 |
| 4,398,549 | 8/1983 | Thomas | 132/270 |

*Primary Examiner*—Robert P. Swiatek
*Assistant Examiner*—Adriene J. Lepiane

[57] ABSTRACT

A substantially rectangular body member molded of a resilient, chemically inert, synthetic material and defining a three sided enclosure has pivotally and swingably interconnected therewith a substantially rectangular cover member, the cover member being swingable between an overlying position with respect to the back of the body member and an overlying position with respect to the front of the body member to cover the enclosure. A base integrally formed with the body member and adapted to be securely placed against the scalp cooperates with a clamp bar swingable into clamping engagement against the body member base to secure selected strands of hair to be treated for frosting or streaking against the base. The clamp bar can be selectively pivotally connected to each end of the base member to accommodate for either left hand or right hand use of the clamp bar.

2 Claims, 2 Drawing Sheets

HAIR FROSTING PURSE

BACKGROUND OF THE INVENTION

In the hair styling procedure referred to commonly as "frosting" or "streaking", spaced groups of hair strands are separated and treated with bleach or dye, usually in the form of a paste or lotion, to effect the desired color "streaked" or "frosted" effect. In my U.S. Pat. No. 4,398,549, issued Aug. 16, 1983, I describe an integrally-molded, fold-together purse for enclosing separated groups of hair strands during such treatment. The present invention relates to an improvement in such frosting purses which not only facilitates and simplifies usage by the operator, but enables more economical manufacture.

SUMMARY OF THE INVENTION

It is, accordingly, the principal object of this invention to obviate the deficiencies of enclosing devices usually used for the treatment of groups of hair strands separated at the scalp in the creation of "frosted" or "streaked" hair style.

A more particular object of the invention is to provide a novel and improved hair frosting or dying purse of the character above described which, being molded of a tough, resilient, substantially chemically inert material, can be reused indefinitely.

Another object of the invention is to devise an improved hair frosting purse which, because of the simplicity of operation, is so easy to apply to the scalp that it can readily be used for self treatment at home as well as by the professional beauty operator.

Other objects, features and advantages of the invention will be apparent by the following description when read with reference to the accompanying drawings.

BRIEF DESCRIPTION OF THE DRAWINGS

In the drawings, wherein like reference numerals denote corresponding parts throughout the several views.

DESCRIPTION OF THE PREFERRED EMBODIMENT

Figure 1:
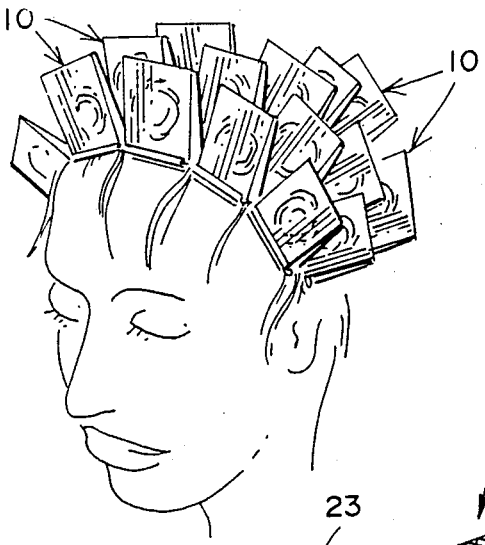
FIG. 1 illustrates, in perspective, the head of a person fitted with a plurality of hair frosting purses embodying the invention for dying or bleaching selected groups of hair strands.
Figure 2:
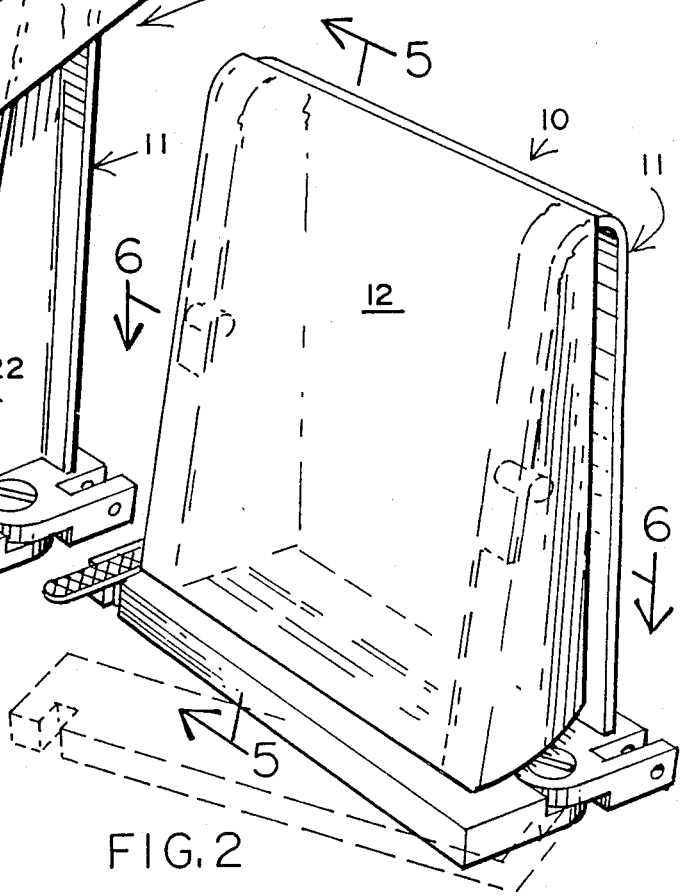
FIG. 2 is an oblique view of a hair frosting purse embodying the invention, shown separately and in closed condition.

Referring now in detail to the drawings, reference numeral 10 designates, generally, a hair frosting purse embodying the invention, a plurality thereof being shown in use in FIG. 1 in the performance of a hair streaking procedure, as is hereinafter more particularly described. As best illustrated in FIG. 2, the hair frosting purse comprises an integrally formed body member 11 and an integrally formed cover member 12 swingably interconnected therewith in the manner and for the purpose hereinafter appearing. The body member 11 is formed with a substantially rectangular base portion 13, a pair of generally triangular sidewall portions 14, 15, and a rectangular back-wall member 16. The peripheral edges of the sidewall portions 14, 15 are integrally formed with opposed, perpendicularly outwardly-extending retaining flange portions 17, 18, respectively. The upper ends of the side wall portions 14, 15 are arcuately curved, and the retaining flange portions 17 18 extend approximately half-way down the front of said side walls to terminate at shoulders 21, 22 (see FIG. 4).

The cover member 12 is formed with front wall portion 23 and side wall portions 24 25, said side wall portions being integrally formed with guide pins 26, 27, respectively, extending inwardly so as to be captured behind the opposed retaining flange portions 17, 18 of the body member 11 upon assembly of the hair purse.

Figure 7:
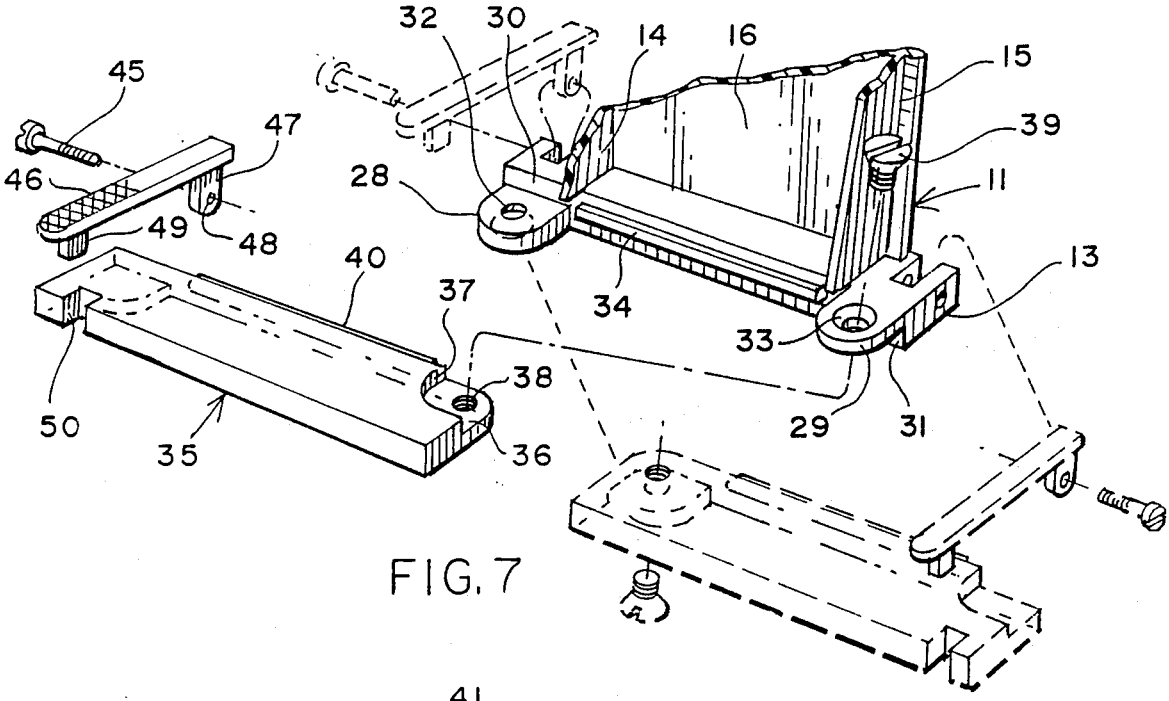
FIG. 7 is a partial exploded view of the purse, illustrating details of the clamp bar mechanism for securing it in place on the head.

As best illustrated in FIG. 7, the body member base 13 is integrally formed with left and right hand front lugs 28, 29, respectively, said lugs being lesser in thickness than that of the remainder of the body member base from which they extend, and so formed as to define upper and lower shoulders 30, 31, respectively, providing recesses for the swinging reception, selectively, of a clamp bar 35, as is hereinbelow more particularly described. The front lugs 28, 29 are formed with respective countersunk openings 32, 33. The front wall of the body member base 13, between the lugs 28, 29, is integrally formed with an elongated, rectangular projection 34. The clamp bar 35 has an arcuate recess 36 at one end, of such size as to interfittingly receive therein the right front lug 29, swingably retained therein by a machine screw 39. The clamp bar 35 is formed along its inner edge with an elongated, substantially rectangular projection 40 which, when the purse is closed as is hereinafter more particularly described, clamps against the rectangular projection 34 of the body member base 13.

Figure 6:
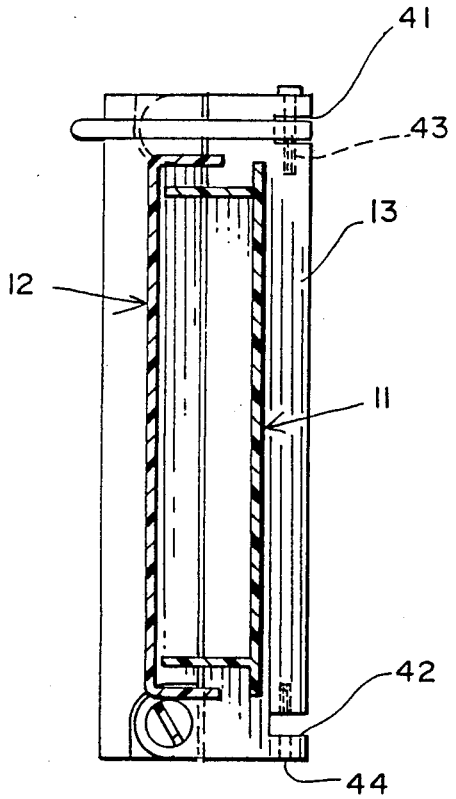
FIG. 6 is a horizontal cross-sectional view, taken along the plane indicated of 6—6 of FIG. 2 in the direction of the arrow.
Figure 5:
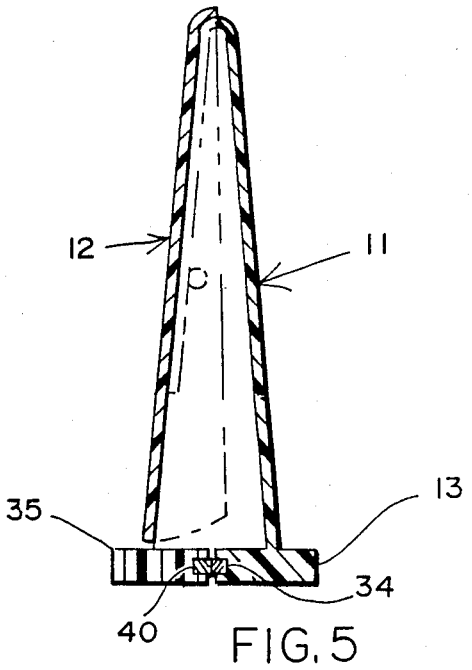
FIG. 5 is a vertical cross-sectional view taken along the plane indicated at 5—5 in FIG. 2.

Means is provided for securely holding the clamp bar in place when it is closed against the body member base 13. To this end, the base member 13 is formed with a pair of left and right hand, vertically-extending rectangular slots 41, 42, (see FIG. 6). Transverse cross bores 43, 44 through the slots 41, 42, respectively, are threaded at the insides for the selective reception of a pivot screw 45, (see FIG. 7). A lock bar 46 is formed with a depending lug portion 47 at one end receivable in the left hand rectangular slot 41, as illustrated by the full-line representation thereof in FIG. 7, said lock bar being swingably held in place by the pivot screw 45, extending through a bore 48 in the lug portion 47. The lock bar 46 is also formed with a downwardly-extending, rectangular retaining portion 49, receivable in a rectangular recess 50 formed in the clamp bar 35 for securing said clamp bar in locked position, as illustrated in FIG. 2 for example. As illustrated by the broken line representation thereof in FIG. 7, the construction of the base member 13 and the clamp bar 35 are such that the clamp bar is reversible, i.e., the clamp bar can be swingably attached to either end of the body member to accommodate use by either left or right-handed operators.

Figure 3:
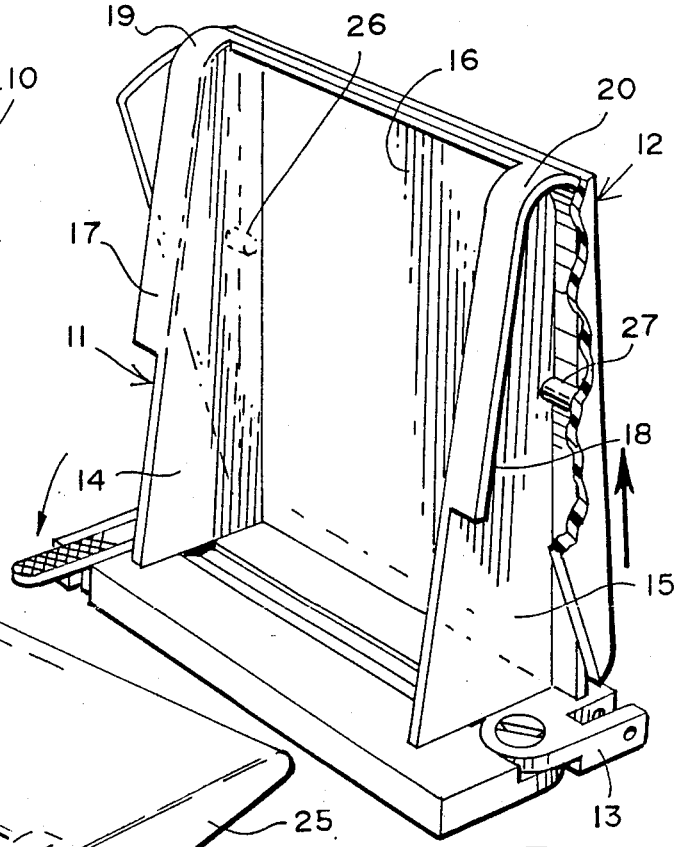
FIG. 3 is an oblique view similar to that of FIG. 2 but showing the front portion of the cover broken away to reveal constructional details.
Figure 4:
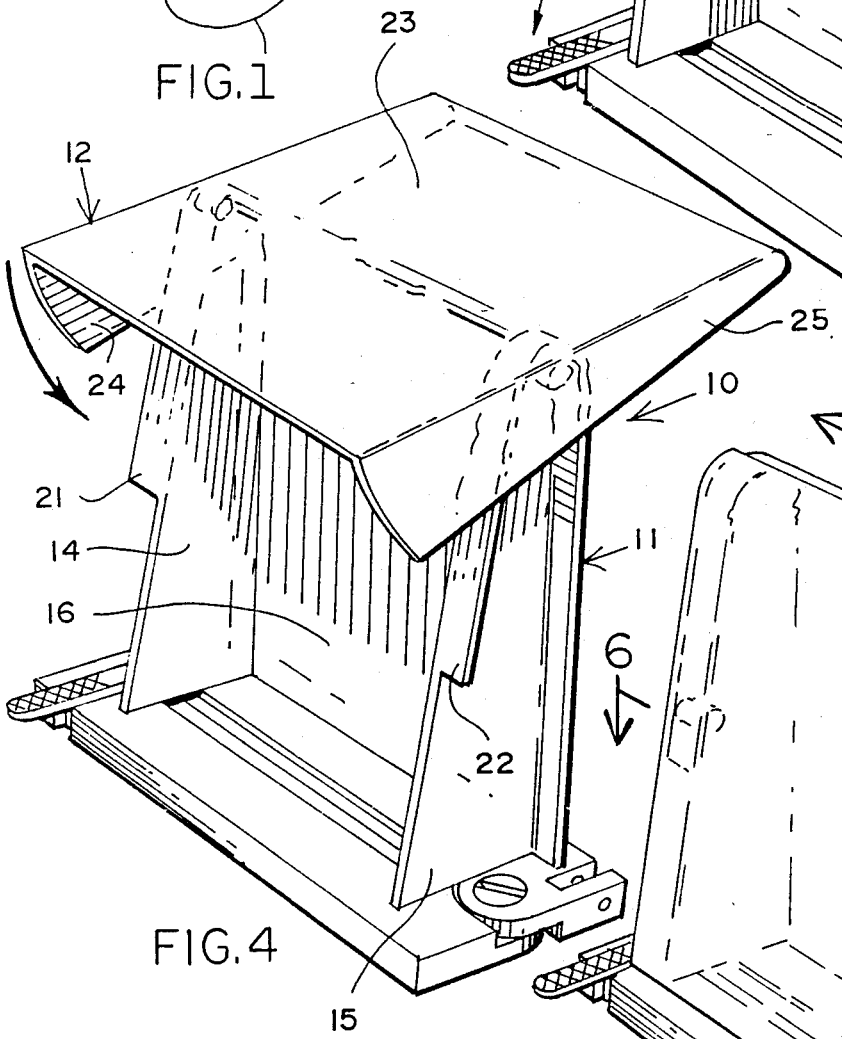
FIG. 4 is an oblique view similar to that of FIGS. 2 and 3, but showing how the cover swings from open to closed position during application of the purse to the head of the person being treated.

In use in dying or bleaching hair strand sections in the hair styling procedure referred to commonly as "frosting" or "streaking", spaced groups or sections of hair strands are separated from the rest of the hair at the scalp. An open purse embodying the invention will then be placed base down against the scalp adjacent to the selected group or sections of hair to be treated, and clamped in place by moving the clamp bar 35 to locked position, illustrated in FIG. 3. The projections 34, 40 of the body member 13 and clamp bar 35 respectively, securely clamp the selected hair strands in place. The treating lotion or paste will then be applied to the clamped strand groups wound within the enclosure, after which the cover member 12 will be lifted from the back to the front, as illustrated in FIG. 4., as guided by the guide pins 26, 27 to cover the wound and treated strands. As illustrated in FIG. 1 this procedure is repeated by use of a plurality of the hair frosting purses to streak as much of the hair as is necessary to create the desired "streaked" or "frosted" effect in the coiffure.

While I have illustrated and described herein only one form in which my invention can be conveniently embodied in practice, it is to be understood that this embodiment is presented by way of example only, and not in a limiting sense. The invention, in brief, comprises all the embodiments and modifications coming within the scope and spirit of the following claims.

I claim:

1. A hair frosting or streaking purse comprising, in combination, a substantially rectangular enclosure body member having longitudinally-extending side-walls and defining a three-sided enclosure, a substantially rectangular cover member, means pivotally and swingably interconnecting said body member with said cover member for movement of said cover member between a first position overlying the back of said body member and a second position overlying the front thereof in fully enclosing position with respect thereto, a base member integrally formed with said body member and defining an under-surface adapted to seat against the scalp when in use, and means for releasably clamping hair strands against said base member prior to moving said cover member from said first to said second position, said pivotally and swingably interconnecting means comprising a pair of opposed flange portions extending outwardly of the peripheral edge of said sidewalls, said cover member having opposed sidewalls overlying said body member sidewalls, said cover member sidewalls being integrally formed with a pair of opposed, inwardly directed guide pins captured, respectively one each, behind said pair of opposed flange portions.

2. A hair frosting or streaking purse comprising, in combination, a substantially rectangular enclosure body member having longitudinally-extending side-walls and defining a three-sided enclosure, a substantially rectangular cover member, means pivotally and swingably interconnecting said body member with said cover member for movement of said cover member between a first position overlying the back of said body member and a second position overlying the front thereof in fully enclosing position with respect thereto, a base member integrally formed with said body member and defining an under-surface adapted to seat against the scalp when in use, and means for releasably clamping hair strands against said base member prior to moving said cover member from said first to said second position, said releasable clamping means comprising an elongated clamp bar, means pivotally connecting said clamp bar to one end of said base member, said base member being substantially rectangular in shape and having a longitudinally extending front edge, said clamp bar having a longitudinally extending edge movable between non-clamping and clamping positions with respect to the front edge of said base member, means for locking said clamp bar in place when in said clamping position, said pivotal connection means comprising journalling means at each end of said base member and at each end of said clamp bar whereby said clamp bar can be selectively pivotally connected to either end of said base member to accommodate for either left hand or right hand use of the clamp bar in clamping strands of hair.

* * * * *